US006892651B1

(12) United States Patent
Van Reed et al.

(10) Patent No.: US 6,892,651 B1
(45) Date of Patent: May 17, 2005

(54) MODULAR STORAGE PLATFORM SYSTEM

(76) Inventors: Barbara Van Reed, P.O. Box 1344, Douglas, MA (US) 01516; Paul E. Brefka, 196 Cordaville Rd., Southborough, MA (US) 01772

( * ) Notice: Subject to any disclaimer, the term of this patent is extended or adjusted under 35 U.S.C. 154(b) by 301 days.

(21) Appl. No.: 10/318,728

(22) Filed: Dec. 16, 2002

(51) Int. Cl.[7] ..... B65D 19/12
(52) U.S. Cl. ..... 108/56.1; 108/180
(58) Field of Search ..... 108/56.1, 56.3, 108/51.11, 180, 181, 153.1, 158.12; 248/188, 248/188.1, 243, 244

(56) References Cited

U.S. PATENT DOCUMENTS 3,301,200 A * 1/1967 Landsiedel ..... 108/56.1
3,779,177 A * 12/1973 Gigante ..... 108/158.12
4,163,537 A * 8/1979 Mourgue ..... 248/188.1
4,735,154 A * 4/1988 Hemery ..... 108/56.1
4,869,179 A * 9/1989 Sammons et al. ..... 108/56.1
5,105,746 A * 4/1992 Reynolds ..... 108/56.1
5,365,859 A * 11/1994 Schrage ..... 108/56.1
5,458,069 A * 10/1995 Stolzman ..... 108/56.3
5,562,047 A * 10/1996 Forney et al. ..... 108/56.1

* cited by examiner

*Primary Examiner*—Jose V. Chen
(74) *Attorney, Agent, or Firm*—William Nitkin

(57) ABSTRACT

A modular storage platform system is disclosed utilizing a plurality of crosspieces interengaged with one another by a plurality of connector members to form a platform base on which can optionally be disposed a cover sheet.

10 Claims, 5 Drawing Sheets

MODULAR STORAGE PLATFORM SYSTEM

BACKGROUND OF THE INVENTION

1. Field of the Invention

The structure of this invention resides in the area of platforms and more particularly relates to a modular platform storage system constructed of crosspiece members and connector members in some embodiments with a cover sheet attached thereto.

2. Description of the Prior Art

Storage platforms have long been in use for the raising of such goods off the ground surface. While typical prior art platforms can be constructed entirely of wood, combination wood and plastic platforms or platforms made entirely of plastic are known, such as taught in U.S. Pat. No. 5,458,069 to Stolzman. Storage platforms having interchangeable members are taught in U.S. Pat. No. 5,461,988 to Cummings et al. Modular storage platforms composed of interlocking members are also known in the art such as taught in U.S. Pat. No. 5,676,067 to Breindel.

SUMMARY OF THE INVENTION

It is an object of this invention to provide a modular, multiconfigurable storage platform system that is especially adapted for home and business use to protect objects stored thereon by keeping them off the floor. In many homes and businesses moisture from concrete floors and walls can ruin the contents of boxes and objects placed directly on the floor. By using the platform system of this invention such objects can be kept safe off wet or Clamp floors. The platform of this invention has openings within its crosspieces to allow for fluid to flow under and through the platforms without damaging any items stored thereon. Also, air can freely circulate through such openings as well as under and around the platforms to keep items stored thereon well ventilated and dry. Further, cleaning and vacuuming of the floor under the platform can be done through such openings without the need of moving the platform.

It is a further object of this invention to provide a modular platform which is easy to assemble from its component parts and which can be assembled in a variety of configurations, as described further below. When storage needs change, the platform of this invention can be easily disassembled for storage or can be reassembled in a different configuration. The platform of this invention, being primarily made of plastic, is impervious to moisture and will not rot or rust.

The storage platform of this invention consists of a plurality of crosspieces which are interconnected at their ends (or in some instances, at their central portions) by engagement with connector members. Each crosspiece consists of an elongated plastic member having spaced apart ends with engagement protrusions extending therefrom on extension web on each end. A central receipt area is defined in the central portion of each crosspiece for receipt of engagement protrusions in each side thereof so as to dispose another crosspiece at right angles to the engaged into crosspiece. A plurality of connector members are utilized to engage the ends of the crosspieces together as desired. The generally rectangular connector members have four receipt areas, each having a receipt slot defined therein for the sliding engagement therein of the engagement protrusion at the end of a crosspiece such that the crosspieces can be interengaged with one another at right angles or in alignment. Small feet are provided under the crosspiece to keep the crosspiece from direct contact with the floor. When assembled, the storage platform of this invention can in some embodiments have a cover sheet of various materials screwed, pinned or nailed to the assembled array of crosspieces which are held together by their interengagement with the connector members and with one another which cover sheet acts as the upper surface of the platform. The platform can also function without a cover sheet, if desired, for large objects, such as, for example, rugs rolled up, lengthy pieces of wood and items that span the space without bending. If a cover sheet is used, it can be made from a sheet of plywood or equivalent material which is screwed, pinned or nailed to holes formed in each crosspiece. In an alternate embodiment the crosspieces of this invention can contain slots defined in their tops which receive a plurality of rods extending from a first crosspiece to its opposite crosspiece, which rods act like a cover sheet in that such rods can support large items placed on the platform.

DESCRIPTION OF THE PREFERRED EMBODIMENT(S)

Figure 1:
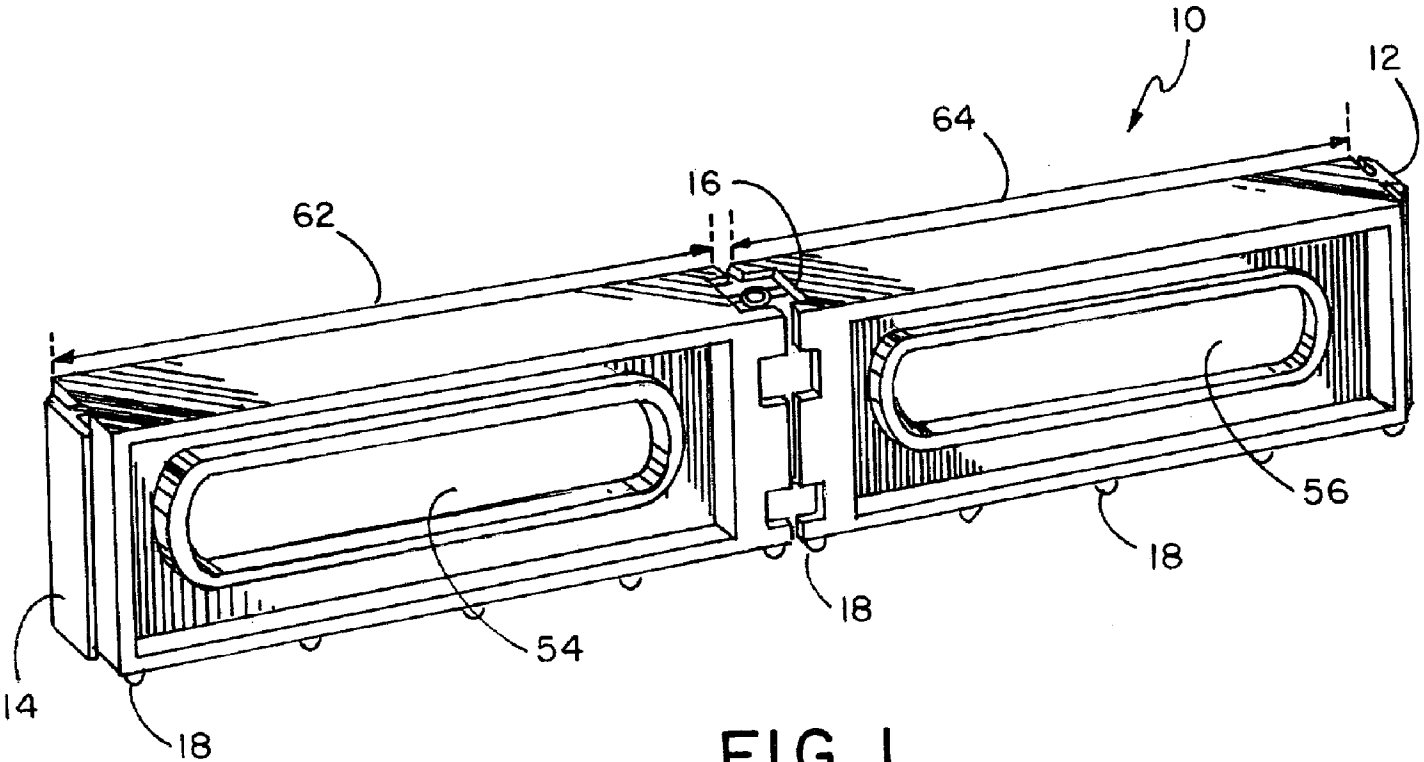
FIG. 1 illustrates a perspective view of a crosspiece of this invention.
Figure 2:
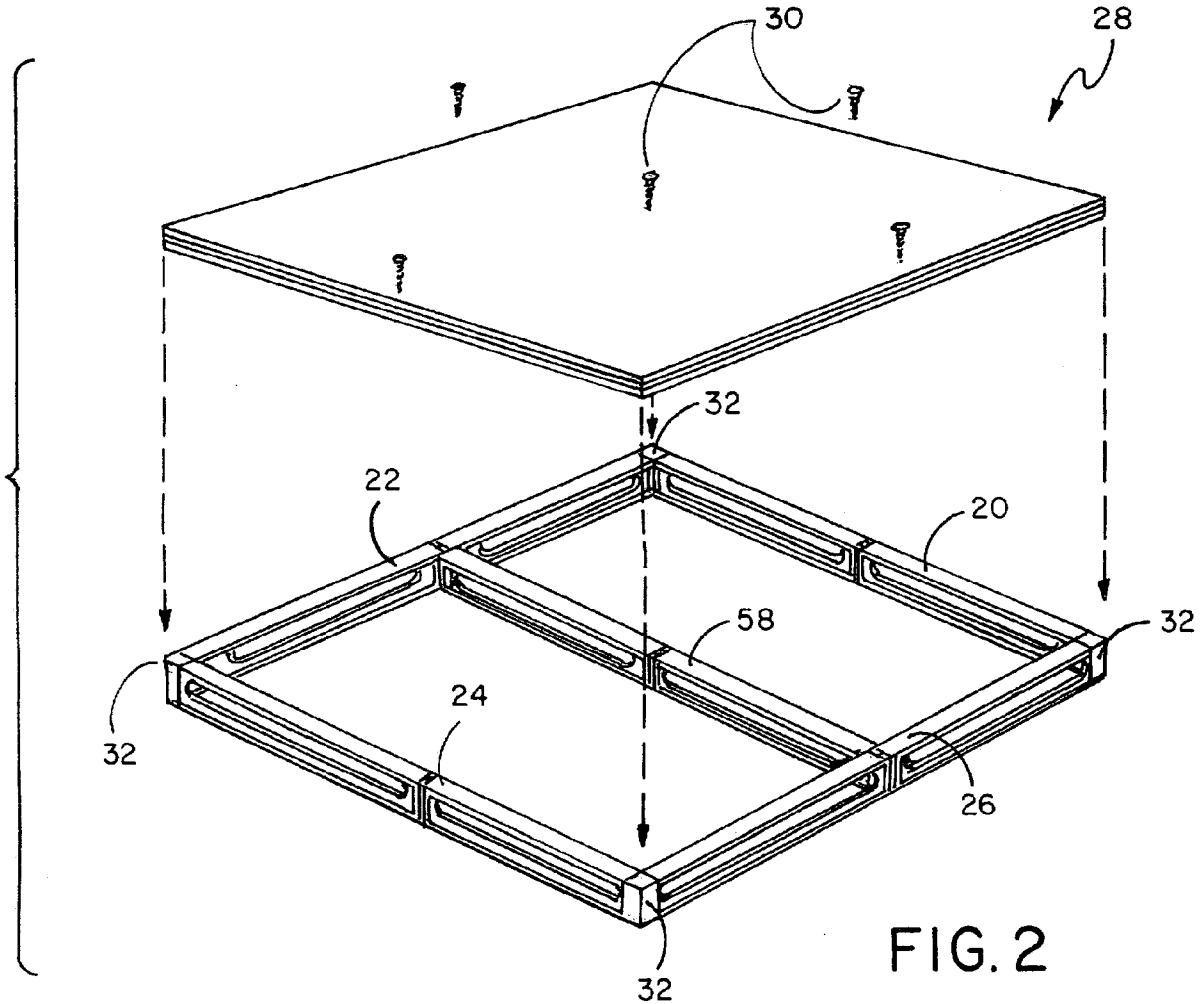
FIG. 2 illustrates a perspective view of a plurality of crosspieces assembled into a square configuration to receive a cover sheet disposed thereabove.

FIG. 1 illustrates a perspective view of crosspiece 10 of this invention. At the first end of the crosspiece is located first engagement protrusion 12 and at the second end of the crosspiece is located second engagement protrusion 14. In the center of crosspiece 10 is defined central receipt area 16. Between the first end and central receipt area 16 is defined first crosspiece portion 62, and between the second end and central receipt area 16 is defined second crosspiece portion 64. First elongated aperture 56 and a second elongated aperture 54 are defined, respectively, in first and second crosspiece portions 62 and 64 which allow for air circulation and also serve to make the crosspiece lighter in weight. At the bottom of the crosspiece are a series of small feet 18 which serve to lift the body of the crosspiece off the floor. Crosspieces can be joined at their ends by connector members, such as connector member 32 seen in FIG. 3. By connecting the ends of the crosspieces, a rectangular structure in one embodiment can be created, as seen in FIG. 2, where first crosspiece 20 is joined by connector members 32 at each end at right angles to second crosspiece 22 and fourth crosspiece 26. At the opposite ends of second crosspiece 22 and fourth crosspiece 26 are connector members 32 engaging those ends to third crosspiece 24. An additional fifth crosspiece 58 is joined from the central receipt area of fourth crosspiece 26 to the central receipt area of second crosspiece 22. Over this rectangular configuration of engaged crosspieces can be positioned optional cover sheet 28 which is of similar size to the assembled crosspieces and which can be held in place by a plurality of attachment members 30 which are engaged through cover sheet 28 into receipt apertures 48, as best seen in FIG. 4. Cover sheet 28 can be made of plywood or equivalent material of sufficient strength to support items placed on the platform.

Figure 3:
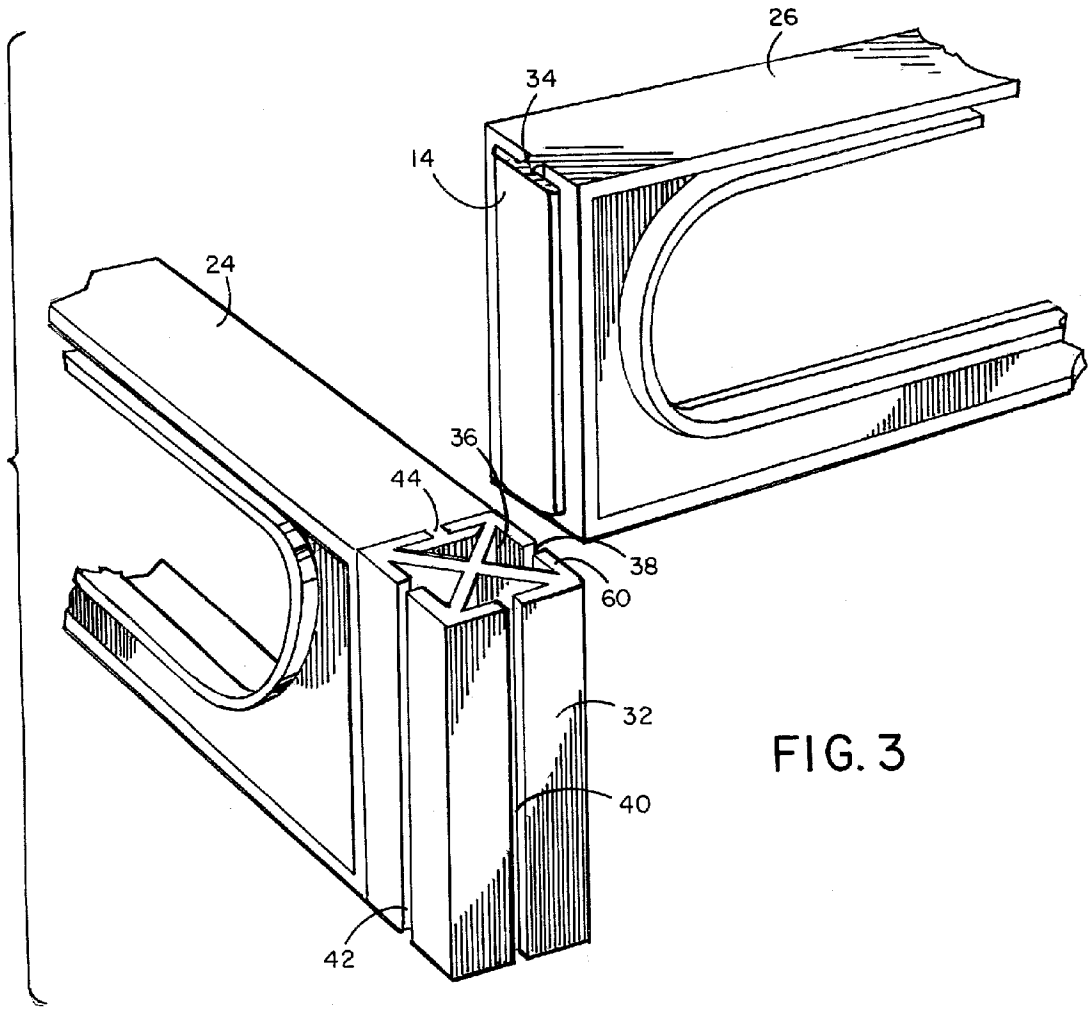
FIG. 3 illustrates a perspective view of the ends of two crosspieces being interengaged into a connector member.
Figure 4:
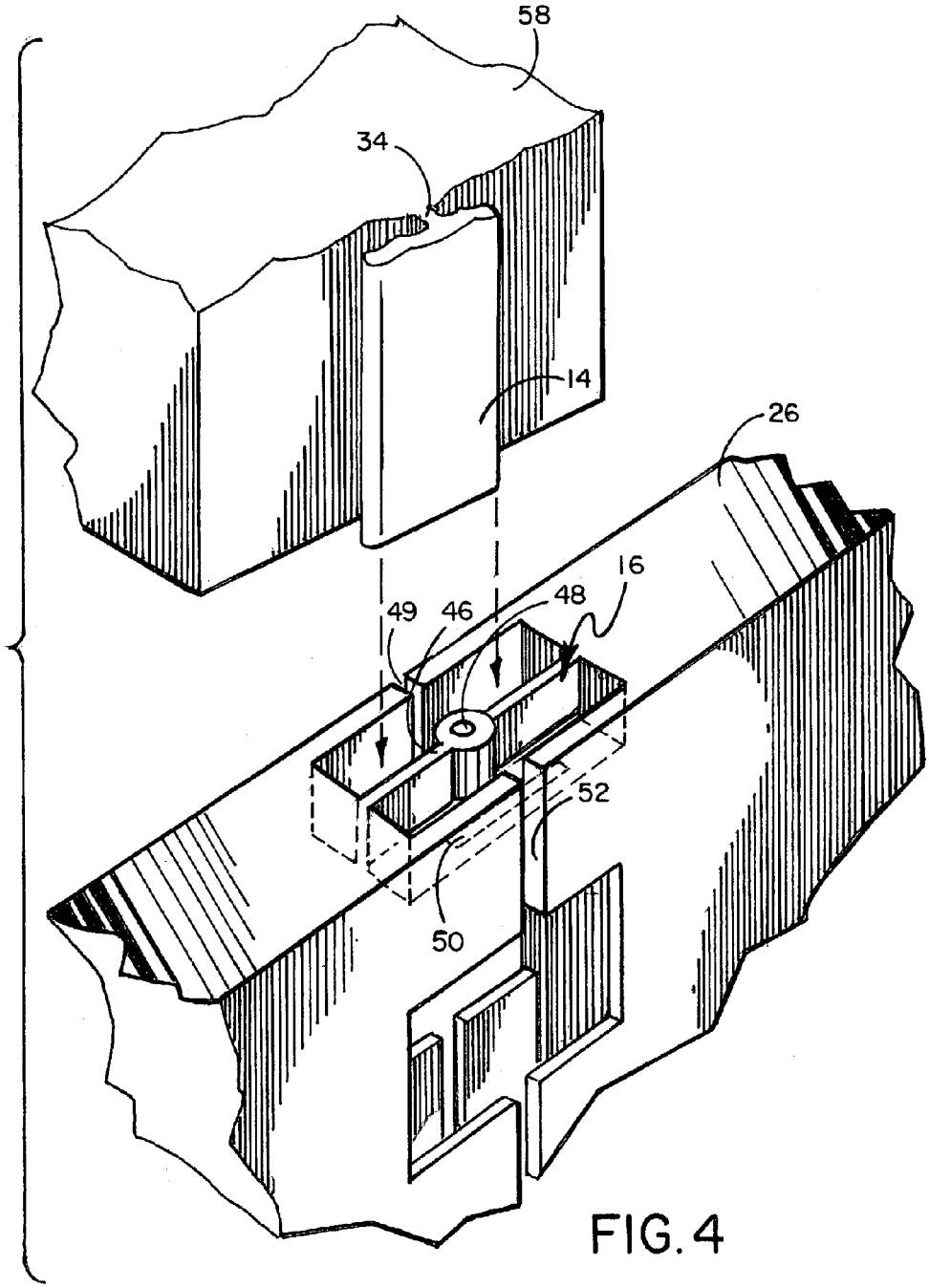
FIG. 4 illustrates a portion of an end of one crosspiece about to be engaged into a central receipt area of another crosspiece.

FIG. 3 illustrates an enlarged view of a connector member 32 engaged to an end of third crosspiece 24 and about to be engaged to an end of fourth crosspiece 26. Connector member 32 is constructed with four receipt areas, such as first engagement protrusion receipt area 36, which are defined by a cross member extending longitudinally through connector member 32. Each receipt area has a receipt slot longitudinally defined in the cross member in association with such receipt area such as first receipt slot 38 which is defined in first engagement protrusion receipt area 36. Similarly other receipt slots are defined in each of the remaining sides of connector member 32, such as second receipt slot 40, third receipt slot 42, and fourth receipt slot 44. The engagement protrusion of third crosspiece 24 has already been engaged into fourth receipt slot 44 so that connector member 32 is removably attached to the end of third crosspiece 24. Fourth crosspiece 26 has at its end second engagement protrusion 14 which is spaced away from fourth crosspiece 26 by extension web 34. Extension web 34 passes within the length of first receipt slot 38 when fourth crosspiece 26 is moved downward to engage it into first engagement protrusion receipt area 36 with second engagement protrusion 14 passing into first receipt area 36 behind wall 60. Extension web 34 is of a length that is similar to the width of wall 60 so that second engagement protrusion 14 passes snugly against the rear of wall 60 and in snug relationship thereto when fourth crosspiece 26 has its second engagement protrusion 14 slid into first engagement protrusion receipt area 36 for engagement of fourth crosspiece 26 to cross member 32. Other crosspieces could be engaged at the same time, if desired, into second receipt slot 40 and/or third receipt slot 42. The platform can be disassembled by merely disengaging the connector member from the end of the crosspiece by sliding the crosspiece's engagement protrusion out of its respective receipt area of the connector member.

FIG. 4 illustrates an enlarged view of the use of central receipt area 16 of fourth crosspiece 26. In this view second engagement protrusion 14 is shown spaced away from an end of fifth crosspiece 58 by extension web 34. Only a portion of fifth crosspiece 58 is illustrated. Central receipt area 16 has a first central protrusion receipt opening 46 defined on one side thereof with a first central receipt slot 49 defined in the outer wall of fourth crosspiece 26. On the opposite side is defined a second central protrusion receipt opening 50 having a second central receipt slot 52 therein. The first and second central protrusion receipt areas are defined to receive therein engagement protrusions at the ends of crosspieces with their respective extension webs passing through their respective central receipt slots. In this way on either or both sides of a crosspiece a second crosspiece can be removably interengaged thereto, as desired, by sliding such second crosspiece's engagement protrusion down the selected protrusion receipt opening so as to engage the second crosspiece at a right angle to the central portion of the first crosspiece. A receipt aperture 48 is defined within the central portion of the central receipt area 16 adapted to receive attachment member 30 passing through cover sheet 28 so as to retain cover sheet 28 in position on the assembled array of crosspieces. In some embodiments the cover sheet need not be rigid and could be of a screen material that can be rolled out or of perforated stock.

Figure 5:
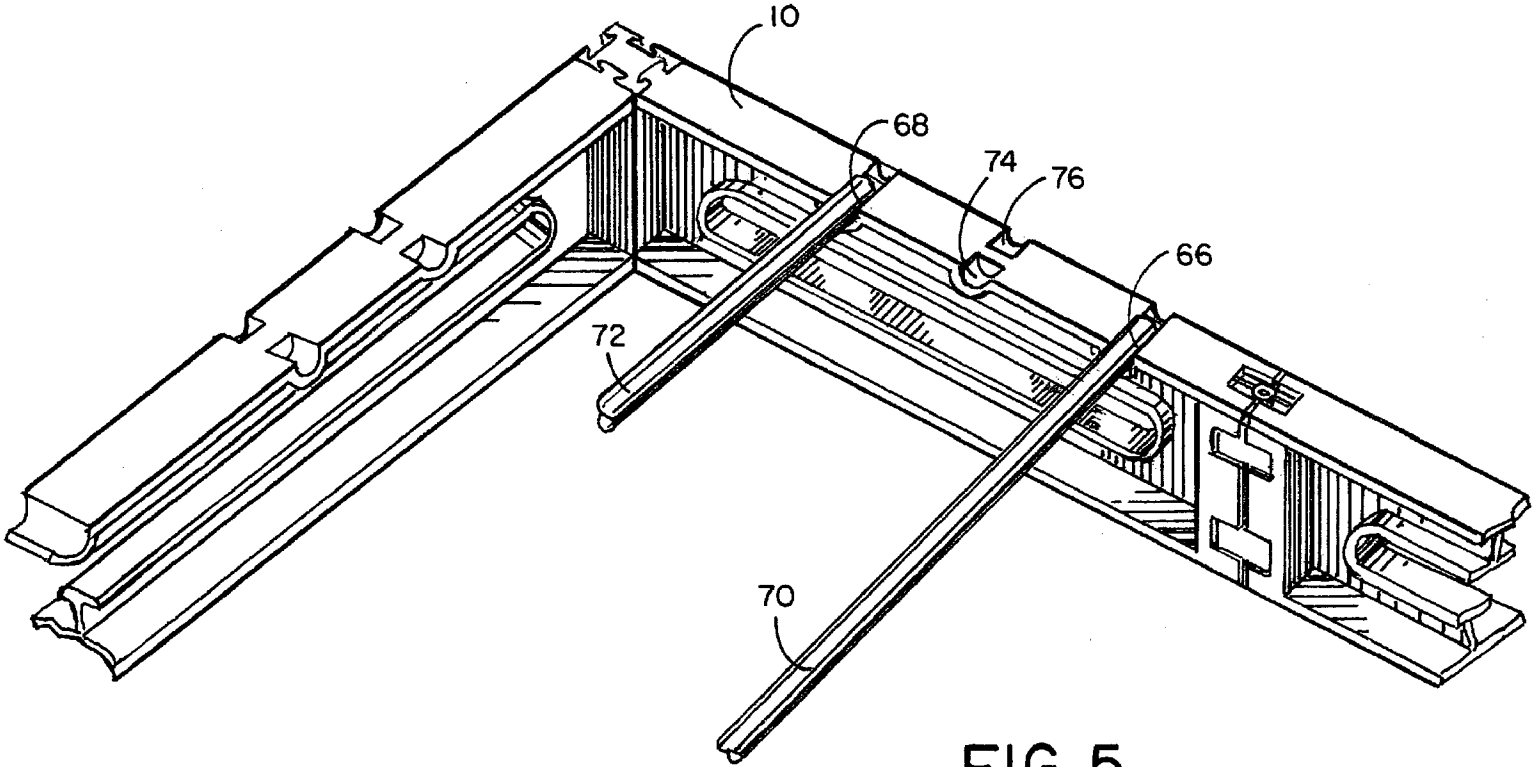
FIG. 5 illustrates a sectional perspective view of crosspieces with rods engaged in slots therein for support of objects to be placed on the platform.

In an alternate embodiment in place of a cover sheet a plurality of rods can be disposed in slots formed in the tops of the crosspieces, such rods extending from a first crosspiece to an opposite second crosspiece to act as supports for large objects placed on the platform. In FIG. 5 a section of crosspiece 10 is shown having slots such as first and second slots 66 and 68 defined in the top thereof extending almost one-half way across the top of the crosspiece for the snug and retentive fit of rods or dowels therein. First and second rods 70 and 72 are seen engaged, respectively, into first and second slots 66 and 68. First and second rods 70 and 72 can be made of metal, plastic or can even be wooden dowels or sticks or any equivalent elongated structure which extends from first and second slots 66 and 68 across to opposite slots in the opposite crosspiece, which opposite crosspiece is not shown in this view. In embodiments where a mid-crosspiece is used, such as mid-crosspiece 58 seen in FIG. 2, the rods would be placed in central slot 74 seen in FIG. 5 to be midway between the mid-crosspiece and the side crosspiece. In situations where the mid-crosspiece is not utilized, first and second slots 66 and 68, which can be defined in both sides of the crosspiece's central receipt area, will equi-space the rods across the top of the platform. Slots defined in the crosspieces can extend on the other side of the top for receipt and retention of rod members extending parallel and aligned with the first set of rod members but extending from the other side of the crosspiece, such as second adjacent slot 76 positioned next to first adjacent slot 74 wherein second adjacent slot 76 can receive a rod extending in the opposite direction of first and second rods 70 and 72. When the mid-crosspiece is utilized, first adjacent slot 74 would have a rod disposed therein, and there would be no rods in first and second slots 66 and 68 as the rod disposed in first adjacent slot 74 would be disposed midway between the mid-crosspiece and the side crosspiece to provide support for a large object placed on the platform.

Although the present invention has been described with reference to particular embodiments, it will be apparent to those skilled in the art that variations and modifications can be substituted therefor without departing from the principles and spirit of the invention.

We claim:

1. A modular storage platform system for constructing a storage platform, comprising:

a plurality of crosspieces, each crosspiece having first and second ends, a top, first and second sides, a base, a central portion disposed midway between said first and second ends, and first and second crosspiece portions defined, respectively between said first end and said central portion and between said second end and said central portion;

first and second engagement protrusions disposed, respectively, on said first and seconds ends of each crosspiece;

an extension web extending between each engagement protrusion and its respective crosspiece end for spacing said engagement protrusion a distance away from the end of said crosspiece;

a central receipt area defined in said central portion of each crosspiece, each central receipt area having first and second central receipt slots defined therein, said first and second central receipt slots facing, respectively, said first and second sides of said crosspiece and adapted to engage with an engagement protrusion of another crosspiece at right angles thereto, said central receipt area having a receipt hole defined therein; and a plurality of substantially rectangular connector members, each connector member having four sides at right angles to its adjacent sides, each side having an engagement protrusion receipt area and a receipt slot extending vertically therein for receiving therein an extension web and engagement protrusion disposed at the ends of each crosspiece, said connector member for interengaging said crosspieces at a right angle or in alignment with one another depending on which engagement protrusion receipt area said engagement protrusion is engaged into.

2. The modular storage platform system of claim 1 further including a planar cover sheet for engagement on said crosspieces and connector members when assembled into a storage platform.

3. The modular storage platform system of claim 2 further including means to connect said cover sheet to said assembled array of crosspieces and connector members.

4. The modular storage platform system of claim 3 wherein said means to connect said cover sheet to said assembled array of crosspieces and connector members comprises a plurality of engagement means, each engaged through said cover sheet into one of said receipt apertures defined in said central receipt areas of said crosspieces.

5. The modular storage platform system of claim 1 further including a plurality of foot extensions disposed on said base of each crosspiece.

6. The modular storage platform system of claim 1 further including a first and second elongated apertures defined, respectively, in said first and second crosspiece portions of each crosspiece.

7. The modular storage platform system of claim 1 further including:

at least one slot defined in the top of each crosspiece; and a rod member having first and second ends, said first end engaged in said slot in a first crosspiece and in an opposing slot defined in an opposite second crosspiece, said rod member for support of objects to be placed on said platform.

8. The modular storage platform system of claim 7 further including:

a plurality of said slots defined in the top of said crosspiece; and a plurality of rods engaged in said slots, each of said rods extending from a slot in a first crosspiece to an opposing slot in an opposite second crosspiece.

9. The modular storage platform system of claim 8 further including a plurality of foot extensions disposed on said base of each crosspiece.

10. The modular storage platform system of claim 9 further including a first and second elongated apertures defined, respectively, in said first and second crosspiece portions of each crosspiece.

* * * * *